US008491347B2

(12) United States Patent
Fischer

(10) Patent No.: US 8,491,347 B2
(45) Date of Patent: Jul. 23, 2013

(54) VARIABLE DIMENSION WATER JET

(76) Inventor: Dana Fischer, Scottsdale, AZ (US)

( * ) Notice: Subject to any disclaimer, the term of this patent is extended or adjusted under 35 U.S.C. 154(b) by 333 days.

(21) Appl. No.: 13/031,973

(22) Filed: Feb. 22, 2011

(65) Prior Publication Data

US 2011/0207375 A1 Aug. 25, 2011

Related U.S. Application Data

(60) Provisional application No. 61/306,796, filed on Feb. 22, 2010.

(51) Int. Cl.
*B63H 11/10* (2006.01)
*B63H 11/103* (2006.01)

(52) U.S. Cl.
USPC ..... 440/38; 440/47

(58) Field of Classification Search
USPC ..... 440/38, 40–43, 47; 60/221, 222
See application file for complete search history.

(56) References Cited

U.S. PATENT DOCUMENTS 3,214,903 A 11/1965 Cochran
3,279,704 A 10/1966 Englehart et al.
3,680,315 A 8/1972 Aschauer et al.
4,092,010 A 5/1978 Carlson, Jr.
7,108,569 B2 9/2006 Cornell

FOREIGN PATENT DOCUMENTS

JP 51055591 A * 5/1976
JP 02128993 A * 5/1990
JP 09002386 A * 1/1997

* cited by examiner

*Primary Examiner* — Ajay Vasudeva
(74) *Attorney, Agent, or Firm* — Keith L. Jenkins, Registered Patent Attorney, LLC; Keith L. Jenkins

(57) ABSTRACT

A quiescently flush resilient portion of a water jet exit channel that distends under controlled fluidic pressure to narrow the flow channel to trade off power for speed in a water-jet-powered watercraft and/or to suppress impeller cavitations during standing starts. The resilient portion may be a continuous annular portion or may be segmented for thrust vectoring. The resilient portion may be built into a water jet exit channel or may be in an add-on nozzle that can be attached to the water jet exit channel, especially for aftermarket improvements. The control system, the water jet exit structure, the water jet, and the watercraft and included. A resilient ring with top and bottom radially outwardly extending flanges mounted on a rigid ring and compressed within a canister between an annular canister floor and a compressive annular cap may provide the plenum and resilient portion of the water jet exit channel.

20 Claims, 12 Drawing Sheets

VARIABLE DIMENSION WATER JET

RELATED APPLICATIONS

This application claims the benefit of U.S. Provisional Patent Application Ser. No. 61/306,796 filed Feb. 22, 2010 by the same inventor.

FIELD OF THE INVENTION

This invention relates to an improved variable-dimension water jet for watercraft. The invention further relates to watercraft having the improved variable-dimension water jet installed thereon.

BACKGROUND

Watercraft that are propelled by water jets are popular. One particular type, the personal watercraft, such as a Jet Ski® made by Kawasaki of Kobe, Japan, is used in racing and for amusement. The water-jet propelled watercraft (hereinafter "watercraft") operates between two extremes of performance. First, there is a need for speed during straight sections of a race course. Second, there is a need for power in turns, or "holes" that form when the watercraft partially or completely submerges during a sharp turn. For speed, a narrower output nozzle is preferred, which increases the speed of the output jet and also the watercraft. For power, a wider nozzle is needed to increase the flow mass and so improve the momentum exchange with the watercraft. Various approaches have been used to deal with these divergent requirements.

One approach is to simply choose either a narrow or a wide nozzle. Some nozzles are adapted to receive various interchangeable inserts that create various constant-diameter nozzles, depending on the race course. Racers on courses with long straight stretches would use a narrower nozzle, while racers on courses with many turns would prefer to equip with wider nozzle.

Various approaches to mechanically squeezing a flexible annular member have been developed. U.S. Pat. No. 5,256,090 to Woolley uses a mechanical linkage to compress to flexible partial cylinders together to vary the nozzle diameter. U.S. Pat. No. 4,092,010 to Carlson. Jr., uses a mechanical wringing action about a flexible nozzle tube to change nozzle diameter. Mechanical manipulation of leaves, as used in modern fighter jet engines, has also been applied to watercraft. One difficulty with such devices is the propensity of debris in the water to become lodged or entangled in the mechanical working or leaves.

U.S. Pat. No. 3,279,704 to Englehart, et al., discloses a VARIABLE NOZZLE (see FIG. 18) for a water jet-propelled watercraft with an annular flexible member adhered to the tapered tail pipe member for adjusting an annular flow of water out of the tailpipe. The annular flexible member is expanded using fluid pressure. Englehart's annular flexible member, in an unexpanded state, narrows the flow through the nozzle. Englehart teaches the use of the annular flexible member with a control element, which appears to be an axially moveable pintle valve. Englehart's annular flexible member is illustrated as being attached by adhesion, in an unreliable way, in that the force that expands the annular flexible member tends to remove the annular member at one end, and the other end wraps around a sharp structural edge, tending to cut the annular member as it flexes. Because Englehart's annular member is on a tapered tail pipe member, the force of the exit water impinges on the annular member at a higher pressure than water merely passing beside anon-tapered tail pipe wall.

Englehart discloses a control system for this water jet nozzle that uses boat speed and water jet speed out the exit nozzle as the inputs, and controls the water jet speed to approximate the boat speed. This control strategy maximizes propulsive efficiency miles per gallon) but not racing performance.

U.S. Pat. No. 3,214,903 to Cochran discloses a JET BOAT NOZZLE (see FIG. 19) comprising an annular flexible inflatable tube of triangular cross-section to provide convergent flow in a watercraft nozzle. Cochran's tube is inflated with air or hydraulic fluid. Cochran's tube creates a tapered nozzle, even in its minimally inflated state, and so the force of the exit water impinges on the tube at a higher pressure than water merely passing beside a non-tapered tail pipe wall. Additionally, the nozzle diameter is always reduced by Cochran's triangular tube. Cochran's tube is bonded to a receptacle that is attached within the tail pipe of a watercraft. Given the variable nature of the forces acting on it, bonding does not appear to be highly reliable. Neither Englehart's nor Cochran's inventions are found in the modern marketplace. Cochran uses the same control strategy as Englehart.

Therefore, a need exists for an improved variable-dimension water jet. In particular, a need exists for a better way to attach a flexible annular member within a water jet nozzle. A need also exists for improved variable-dimension water jet nozzle that does not reduce the diameter of the exit nozzle in a minimally inflated state. A need also exists for an improved variable-dimension water jet nozzle that does not subject the flexible annular member to water pressure forces unnecessarily. A need also exists for an improved variable-dimension water jet nozzle that operates at a lower pressure than previous art. A need also exists for an improved variable-dimension water jet nozzle that can be fitted to watercraft exit nozzles designed for interchangeable inserts. A need also exists for an improved variable-dimension water jet nozzle responsive to a control system that is based on engine rpm and vehicle speed. A need also exists for an improved variable-dimension water jet nozzle and its control system mounted on a watercraft.

OBJECTS AND FEATURES OF THE INVENTION

A primary object and feature of the present invention is to overcome the above-mentioned problems and fulfill the above-mentioned needs.

In addition, it is an object and feature of the present invention to provide a better way to attach a flexible annular member within a water jet nozzle. It is another object and feature of the present invention to provide improved variable-dimension water jet nozzle that does not reduce the diameter of the exit nozzle in a minimally inflated state. It is another object and feature of the present invention to provide an improved variable-dimension water jet nozzle that does not subject the flexible annular member to water pressure forces unnecessarily. It is another object and feature of the present invention to provide an improved variable-dimension water jet nozzle that operates at a lower pressure than previous art. It is another object and feature of the present invention to provide an improved variable-dimension water jet nozzle that can be fitted to watercraft exit nozzles designed for interchangeable inserts. It is another object and feature of the present invention to provide an improved variable-dimension water jet nozzle responsive to a control system that is based on engine rpm and vehicle speed. It is another object and feature of the present invention to provide an improved variable-dimension water jet nozzle and its control system mounted on a watercraft. It is another object and feature of the present invention to provide an improved variable-dimension water jet nozzle and its control system that operates on preventing cavitations on the impeller during standing starts.

It is an additional primary object and feature of the present invention to provide an improved variable-dimension water jet nozzle that is efficient, inexpensive, easy to clean, and handy. Other objects and features of this invention will become apparent with reference to the following descriptions.

SUMMARY OF THE INVENTION

An exemplary embodiment of present invention has a resilient ring attached within a cylindrical nozzle insert such that, in a minimally inflated state, the inner surface of the resilient ring is flush with the inner surface of the cylindrical nozzle insert. The resilient ring has top and bottom radially outward flanges having integral ring seals on their lower sides. A perforated metal ring having a top surface receptive to one of the integral ring seals is positioned between the flanges and receives the top ring seal. The combined resilient ring and perforated ring rest in a ring cavity in the canister of the cylindrical nozzle insert. The ring cavity has a groove on the bottom to receive the lower integral ring seal. The combined resilient ring and perforated ring are held in place by a compressive annular cap on the ring cavity. The space between the perforated metal ring and the inner cylindrical wall of the ring cavity define a pressure plenum, along with the space created by the perforations of the perforated metal ring and along with any space created by inflating the resilient ring to distension. Pressure is supplied by introducing hydraulic oil though a hydraulic line fitting and a bore through the cylindrical wall of the ring cavity and into the pressure plenum. A control system, using as inputs the vehicle speed and the engine rpm, causes pressure to be increased when high speed is needed, and pressure is minimized when more powerful thrust is desired. The cylindrical nozzle insert is installed in a water jet exit nozzle of a watercraft and coupled to its control system.

A variable-dimension water jet including: a water jet exit channel including: a rigid cylindrical portion including: an exit channel dimension; an exit channel length; and a inner cylindrical surface having the exit channel dimension for at least a portion of the exit channel length; a resilient exit channel wall portion including an exit channel surface, where the exit channel surface is flush to the inner cylindrical surface in a first state; a plenum behind the resilient exit channel wall portion; and a pressure inlet into the plenum, operable to conduct pressurized fluid into the plenum to distend the resilient exit channel wall portion into the water jet exit channel. The variable-dimension water jet, where the resilient exit channel wall portion includes a portion of a water jet nozzle, the water jet nozzle including: a canister including: a cylindrical canister wall; an annular canister floor; and a receiver for receiving an compressive annular cap operable to be releasably compressively attached to the canister; a rigid ring including inner, outer, top, and bottom ring surfaces and a plurality of radial perforations; a resilient ring, including: a particular exit channel surface including an inner surface of the resilient ring; an outer surface opposed to the particular exit channel surface; and top and bottom flanges extending radially outward; where the resilient ring is mountable on the perforated rigid ring with: the top and bottom outwardly extending flanges engaging at least a portion of the top and bottom ring surfaces; and the outer resilient ring surface abutting the inner rigid ring surface; and the compressive annular cap operable to compress the resilient ring mounted on the rigid ring between the annular canister floor and the compressive annular cap. The variable-dimension water jet, further including a cylindrical sleeve with an inner dimension equal to the exit channel dimension and extending axially from an inner edge of the annular canister floor. The variable-dimension water jet, including a bleed valve through the cylindrical canister wall and into the plenum. The variable-dimension water jet, where a particular plenum includes a combination of: a space between an interior surface of the cylindrical canister wall and the outer surface of the resilient ring mounted on the rigid ring; and spaces within the radial perforations in the rigid ring. The variable-dimension water jet, where the upper flange of the resilient ring extends sufficiently to cover a top surface of the cylindrical canister wall, when assembled. The variable-dimension water jet, including: a first annular groove in the top surface of the rigid ring; and an integral portion of an O-ring extending from a bottom surface of the top flange of the resilient ring that is sized and shaped to be received in the first annular groove. The variable-dimension water jet, including: a second annular groove in a top surface of the annular canister floor; and an integral portion of an O-ring extending from, a bottom surface of the bottom flange of the resilient ring that is sized and shaped to be received in the second annular groove. The variable-dimension water jet, where, when assembled, the pressure inlet is aligned to a perforation of the radial perforations. The variable-dimension water jet, including a water jet exit structure coupled to the water jet nozzle. The variable-dimension water jet, including a watercraft coupled to the water jet exit structure coupled to the water jet nozzle. The variable-dimension water jet, where the plenum includes one of: a tube ring; and a space between an inner surface of a cylindrical wall and an outer surface of a radially perforated rigid ring within the cylindrical wall together with spaces within the perforations. The variable-dimension water jet, where the pressure of the pressurized fluid at the pressure inlet is controlled to trade off power and speed. The variable-dimension water jet, where the controller is an electronic linear controller including: input connectivity for signals indicating engine speed and vehicle speed; output connectivity for a signal actuating pressure in the plenum; and feedback connectivity for a signal indicating an actuator state. The variable-dimension water jet, further including a watercraft, where the electronic linear controller is coupled to the watercraft. The variable-dimension water jet, where the pressure of the pressurized fluid at the pressure inlet is controlled to reduce impeller cavitations during standing starts of a watercraft. The variable-dimension water jet, further including a watercraft coupled to the variable-dimension water jet.

A variable-dimension water jet including: a water jet exit channel including: a rigid cylindrical portion including: an exit channel dimension; an exit channel length; and an inner cylindrical surface having the exit channel dimension for at least a portion of the exit channel length; a resilient exit channel wall portion including an exit channel surface, where the exit channel surface is flush to the inner cylindrical surface in a first state; a plenum behind the resilient exit channel wall portion where the plenum includes one of: a tube ring; and a space between an inner surface of a cylindrical wall and an outer surface of a radially perforated rigid ring mounted within the cylindrical wall together with spaces within the perforations; a pressure inlet into the plenum, operable to conduct pressurized fluid into the plenum to distend the resilient exit channel wall portion into the water jet exit channel; where the pressure of the pressurized fluid at the pressure inlet is controlled to trade off power and speed; and/or reduce impeller cavitations during standing starts of a watercraft; where the controller is an electronic linear controller including: input connectivity for signals indicating engine speed and vehicle speed; output connectivity for a signal actuating pressure in the plenum; and feedback connectivity for a signal indicating an actuator state. The variable-dimension water jet, where the resilient exit channel wall portion includes a portion of a water jet nozzle, the water jet nozzle including: a canister including: a cylindrical canister wall; an annular canister floor; and a receiver for receiving an compressive annular cap operable to be releasably compressively attached to the canister; a rigid ring including inner, outer, top, and bottom ring surfaces and a plurality of radial perforations; a resilient ring, including: a particular exit channel surface including an inner surface of the resilient ring; an outer surface opposed to the particular exit channel surface; and top and bottom flanges extending radially outward; where the resilient ring is mountable on the perforated rigid ring with: the top and bottom outwardly extending flanges engaging at least a portion of the top and bottom ring surfaces; and the outer resilient ring surface abutting the inner rigid ring surface; and the compressive annular cap operable to compress the resilient ring mounted on the rigid ring between the annular canister floor and the compressive annular cap; a cylindrical sleeve with an inner dimension equal to the exit channel dimension and extending axially from an inner edge of the annular canister floor; a bleed valve through the cylindrical canister wall and into the plenum; a first annular groove in the top surface of the rigid ring; an integral portion of an O-ring extending from a bottom surface of the top flange of the resilient ring that is sized and shaped to be received in the first annular groove; a second annular groove in a top surface of the annular canister floor; and an integral portion of an O-ring extending from a bottom surface of the bottom flange of the resilient ring that is sized and shaped to be received in the second annular groove.

A variable-dimension water jet including: a water jet exit channel including: a rigid cylindrical portion including: an exit channel dimension; an exit channel length; and an inner cylindrical surface having the exit channel dimension for at least a portion of the exit channel length; a resilient exit channel wall portion including an exit channel surface, where the exit channel surface is flush to the inner cylindrical surface in a first state; a plenum behind the resilient exit channel wall portion where the plenum includes either a tube ring or a space between an inner surface of a cylindrical wall and an outer surface of a radially perforated rigid ring mounted within the cylindrical wall together with spaces within the perforations; a pressure inlet into the plenum, operable to conduct pressurized fluid into the plenum to distend the resilient exit channel wall portion into the water jet exit channel; where the pressure of the pressurized fluid at the pressure inlet is controlled to trade off power and speed, and/or reduce impeller cavitations during standing starts of a watercraft; where the controller is an electronic linear controller including: input connectivity for signals indicating engine speed and vehicle speed; output connectivity for a signal actuating pressure in the plenum; and feedback connectivity for a signal indicating an actuator state; where the resilient exit channel wall portion includes either a built in feature of the water jet exit structure or a portion of a water jet nozzle attachable to the water jet exit structure, the water jet nozzle including: a canister including: a cylindrical canister wall; an annular canister floor; and a receiver for receiving an compressive annular cap operable to be releasably compressively attached to the canister; a rigid ring including inner, outer, top, and bottom ring surfaces and a plurality of radial perforations; a resilient ring, including: a particular exit channel surface including an inner surface of the resilient ring; an outer surface opposed to the particular exit channel surface; and top and bottom flanges extending radially outward; where the resilient ring is mountable on the perforated rigid ring with the top and bottom outwardly extending flanges engaging at least a portion of the top and bottom ring surfaces and the outer resilient ring surface abutting the inner rigid ring surface; the compressive annular cap operable to compress the resilient ring mounted on the rigid ring between the annular canister floor and the compressive annular cap; a cylindrical sleeve with an inner dimension equal to the exit channel dimension and extending axially from an inner edge of the annular canister floor; a bleed valve through the cylindrical canister wall and into the plenum; a first annular groove in the top surface of the rigid ring; an integral portion of an O-ring extending from a bottom surface of the top flange of the resilient ring that is sized and shaped to be received in the first annular groove; a second annular groove in a top surface of the annular canister floor; and an integral portion of an O-ring extending from a bottom surface of the bottom flange of the resilient ring that is sized and shaped to be received in the second annular groove.

BRIEF DESCRIPTION OF THE DRAWINGS

The above and other objects and advantages of the present invention will become more apparent from the following description taken in conjunction with the following drawings in which.

DETAILED DESCRIPTION OF THE BEST MODES AND PREFERRED EMBODIMENTS OF THE INVENTION

Figure 1:
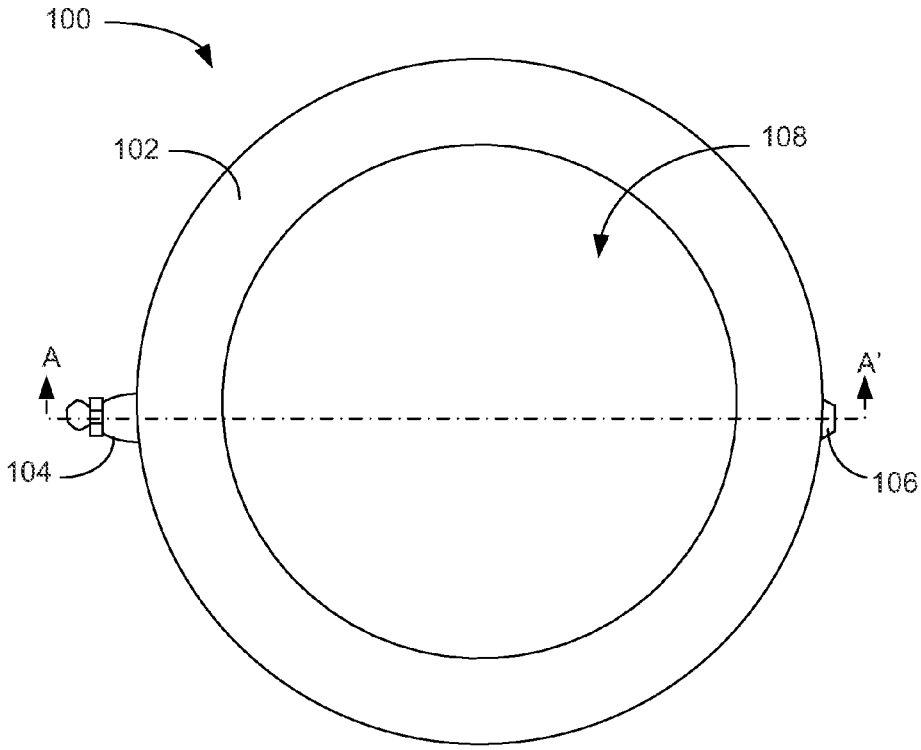
FIG. 1 is a top plan view illustrating an exemplary improved variable-dimension water jet nozzle and defining cross-section A-A', according to a preferred embodiment of the present invention.

FIG. 1 is a top plan view illustrating an exemplary improved variable-diameter water jet nozzle 100 and defining cross-section A-A', according to a preferred embodiment of the present invention. Exemplary compressive annular cap 102, illustrated throughout as a screw cap, surrounds the flow channel 108 of the exemplary improved variable-dimension water jet nozzle 100. Exemplary hydraulic fitting 104 protrudes to the left. Exemplary bleed valve 106 protrudes slightly to the right. Cross-section A-A' cuts through the hydraulic fitting 104 and the bleed valve 106. In various embodiments, the positional relationship of the hydraulic fitting 104 and the bleed valve 106 may be varied. In a preferred embodiment, bleed valve 106 is oriented at the top of the exemplary improved variable-dimension water jet nozzle 100, to assist in bleeding air from the hydraulic oil within the plenum. Preferably, the hydraulic oil is an environmentally friendly hydraulic oil, such as those manufactured by Hydro Safe Oil Division, Inc. of Dewitt, Minn. While the improved variable-diameter water jet nozzle 100 is illustrated as having a circular flow channel 108, other cross-sectional shapes, such as elliptical, or polygonal with rounded corners, for example, are within the scope of the present invention. Each shape has a characteristic dimension. For example, for the circle the characteristic dimension would be a diameter, while for the ellipse the characteristic dimension may be the semi-major axis. In the exemplary embodiments provided herein, a circular flow channel 108 is used, but the invention is not so limited.

Figure 2:
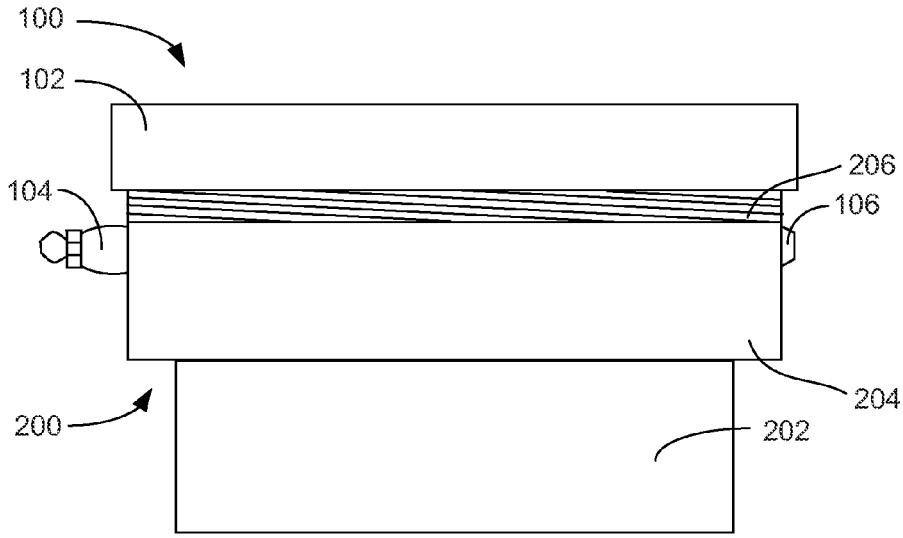
FIG. 2 is a side elevation view illustrating the exemplary improved variable-dimension water jet nozzle, according to the preferred embodiment of FIG. 1.

FIG. 2 is a side elevation view illustrating the exemplary improved variable-dimension water jet nozzle 100, according to the preferred embodiment of FIG. 1. Exemplary canister 204 is preferably integral with exemplary sleeve 202 to form nozzle insert 200. As will be discussed in more detail below, sleeve 202 fits within an annular notch 1406 of a water let exit structure 1400 (see FIG. 14). Canister 204 has a threaded portion 206 to match threads inside compressive annular cap 102. The use of threads is exemplary, and various types of compressive caps, as are known in the art, are within the scope of the present invention. In a particular embodiment, the perimeter of the compressive annular cap 102 may have flat sides for receiving a wrench.

Figure 3:
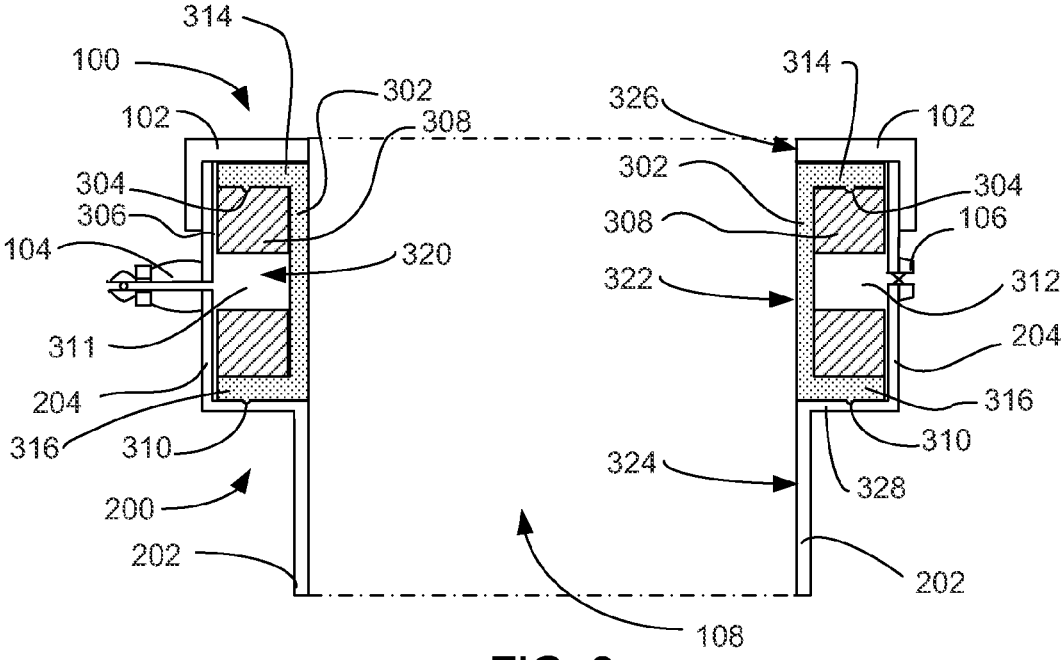
FIG. 3 is a side cross-sectional view through section A-A' illustrating an exemplary improved variable-dimension water jet nozzle, showing the resilient ring minimally inflated and flush with the inner surface of the cylindrical nozzle insert, according to the preferred embodiment of FIG. 1.

FIG. 3 is a side cross-sectional view through section A-A' illustrating an exemplary improved variable-dimension water jet nozzle 101), showing the resilient ring 302 minimally inflated and having an interior surface, or exit channel surface, 322 flush with the inner surface 324 of the cylindrical nozzle insert 200 and with the inner surface 326 of the compressive annular cap 102, according to the preferred embodiment of FIG. 1. Side pressure from an exit water stream is about 12 psi in this configuration, which defines the minimum inflation pressure. Some variation in minimum inflation pressure levels will be observed across the set of all watercraft 1700, depending on the design of the engine 1704, the impeller 1710 (see FIG. 17) and the water jet exit structure 1400 (See FIG. 14). Resilient ring 302 has a top radially outward flange 314 that has an integral ring seal 304 extending from a bottom surface of the top radially outward flange 314, as shown. Resilient ring 302 also has a bottom radially outward flange 316 that has an integral ring seal 310 extending from a bottom surface of the bottom radially outward flange 316, as shown. Exemplary canister 204 has an annular groove in canister floor 328 for receiving ring seal 310, as shown.

Exemplary perforated metal ring 308 is positioned between top radially outward flange 314 and bottom radially outward flange 316, as shown. Compressive annular cap 102 compresses top radially outward flange 314 and bottom radially outward flange 316 via perforated metal ring 308. Perforated metal ring 308 has a top annular groove for receiving top ring seal 304, as shown. Exemplary perforations 311 and 312 in perforated metal ring 308 are illustrated as being aligned to the hydraulic fitting 104 and the bleed valve 106, respectively, but the invention is not so limited. A thin annular gap 306 between the perforated metal ring 308 and the inner surface of canister 204, exaggerated in the illustration, forms a plenum 320, along with the space inside perforations in the perforated metal ring 308, such as perforations 311 and 312, and space 402 (see FIG. 4) created by distension of the resilient ring 302 under pressure.

In the configuration of FIG. 3, the maximum power that the water jet exit structure 1400 (See FIG. 14) can produce for a given engine 1704 and impeller 1710 (see FIG. 17) is produced. An advantage of the present invention is that it does not lower the maximum power capability of the water jet nozzle 100 by imposing a flow restriction when the resilient ring 302 is minimally inflated. Compare the prior arts of FIGS. 18 and 19 to appreciate the advantage of the present invention.

Figure 4:
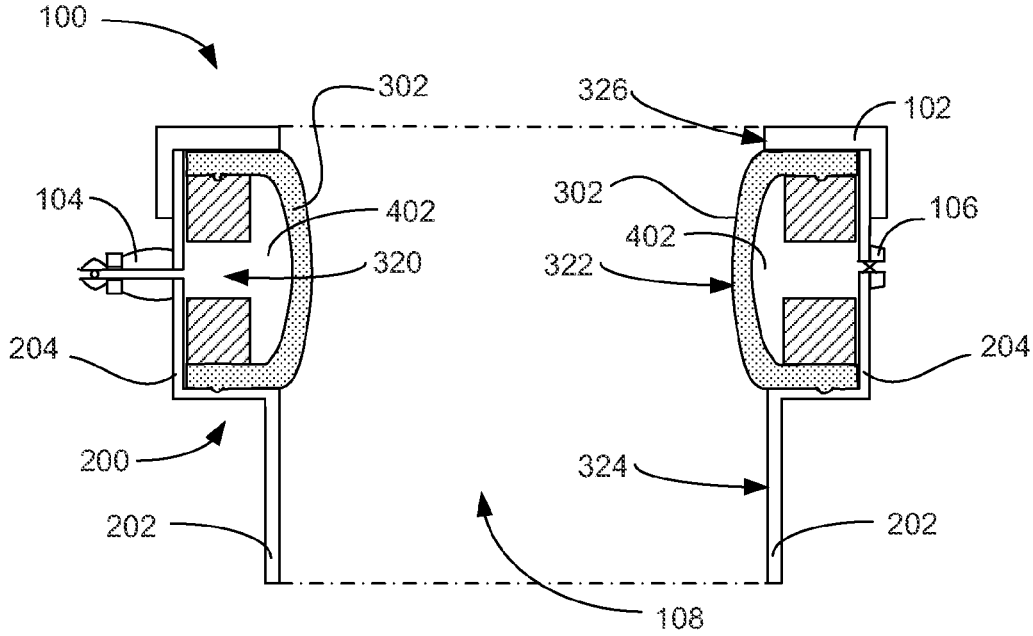
FIG. 4 is a side cross-sectional view through section A-A' illustrating an exemplary improved variable-dimension water jet nozzle, showing the resilient ring inflated and extending interior to the inner surface of the cylindrical nozzle insert, according to the preferred embodiment of FIG. 1.

FIG. 4 is a side cross-sectional view through section A-A' illustrating an exemplary improved variable-dimension water jet nozzle 100, showing the resilient ring 302 inflated and extending interior to the inner surface 324 of the cylindrical nozzle insert 200 and interior to the inner surface 326 of compressive annular cap 102, according to the preferred embodiment of FIG. 1. Increased pressure in the expandable plenum 320 distends resilient ring 302 further into the interior 108 of the cylindrical nozzle insert 200. Space 402, behind resilient ring 302, is filled with pressurized hydraulic oil, and is part of expandable plenum 320. It should be appreciated that the word "cylindrical", as defines and used herein, is not limited to referring to right circular cylinders or to circular cylinders, despite the fact that the exemplary embodiments use the circular case.

Figure 5:
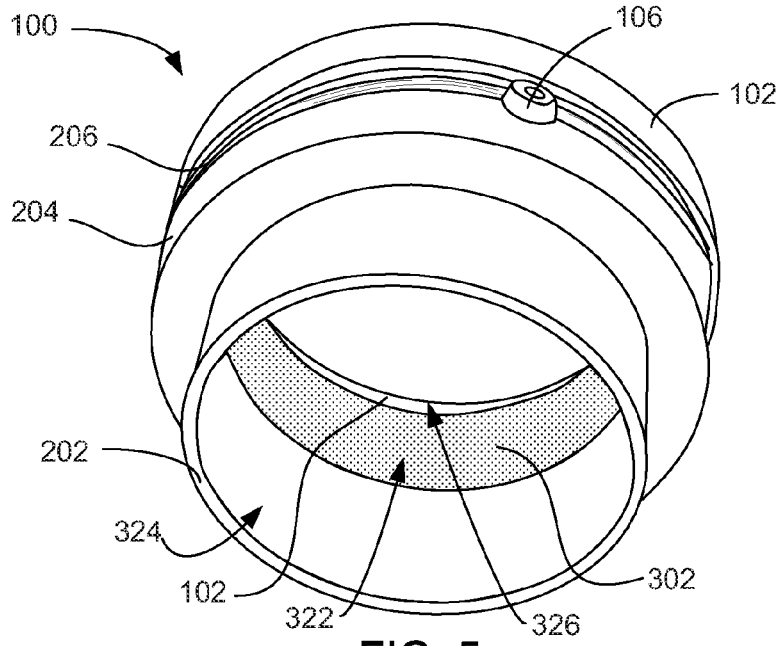
FIG. 5 is a bottom perspective view illustrating the improved variable-dimension water jet nozzle, according to the preferred embodiment of FIG. 1.

FIG. 5 is a bottom perspective view illustrating the improved variable-dimension water let nozzle 100, according to the preferred embodiment of FIG. 1. The exit channel surface 322 of resilient ring 302 is flush with the inner surface 324 of sleeve 202 and inner surface 326 of compressive annular cap 102, indicating minimal inflation.

Figure 6:
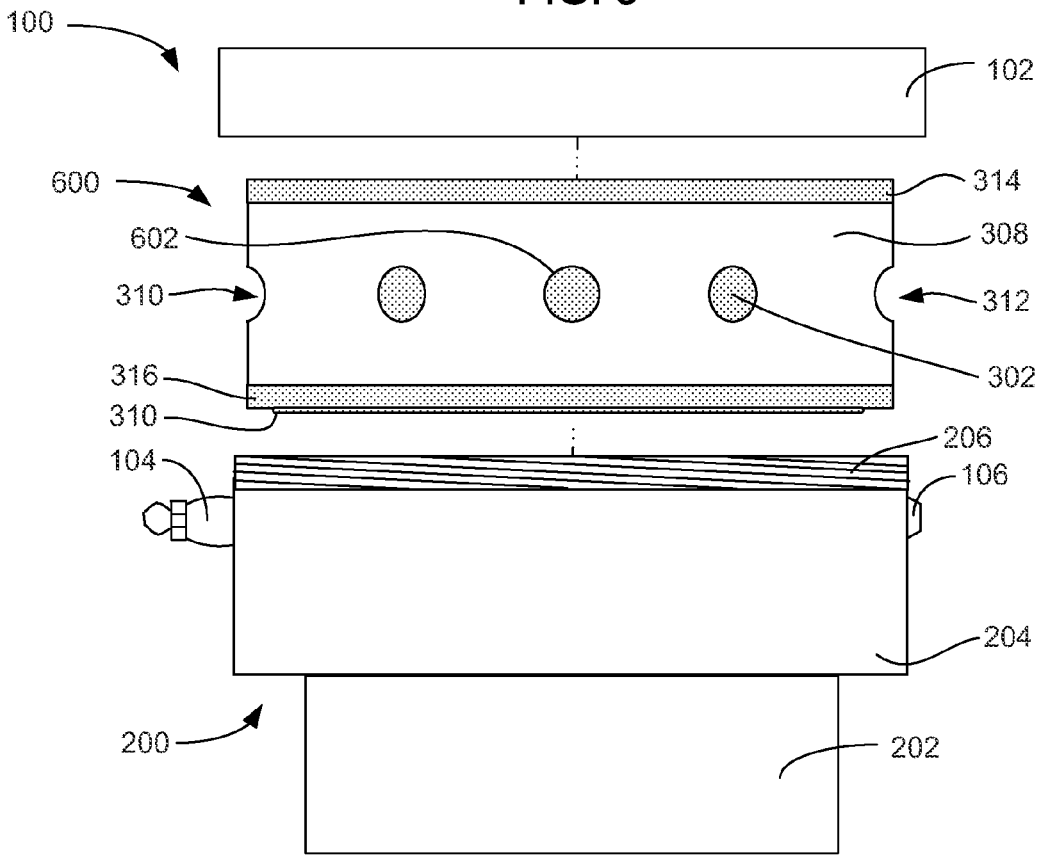
FIG. 6 is an exploded side elevation view illustrating the improved variable-dimension water jet nozzle, according to the preferred embodiment of FIG. 1.

FIG. 6 is an exploded side elevation view illustrating the improved variable-dimension water jet nozzle 100, according to the preferred embodiment of FIG. 1. The ring assembly 600 of perforated metal ring 308 and resilient ring 302 is shown assembled. Perforations 311 and 312 are as previously described, and additional perforations 602 (one of three labeled) are visible in this view. In various preferred embodiments, the number of perforations 311, 312, 602 may range from one to ten, with the range of six to eight being most preferred. The ring assembly 600 shows the outside edges of top radially outward flange 314 and bottom radially outward flange 316 flush with the outside edge of perforated metal ring 308. Resilient ring 302 is sufficiently flexible to be easily manually inserted into perforated metal ring 308. The ring assembly 600 is inserted into canister 204 in the orientation shown, preferably with one perforation (such as perforation 311) aligned with the hydraulic fitting 104. Compressive annular cap 102 engages threaded portion 206 on cylindrical nozzle insert 200 to secure the ring assembly 600 in the canister 204 and to compress top radially outward flange 314 and bottom radially outward flange 316 between perforated metal ring 308 and compressive annular cap 102 at the top and canister floor 328 at the bottom, respectively.

Figure 7A:
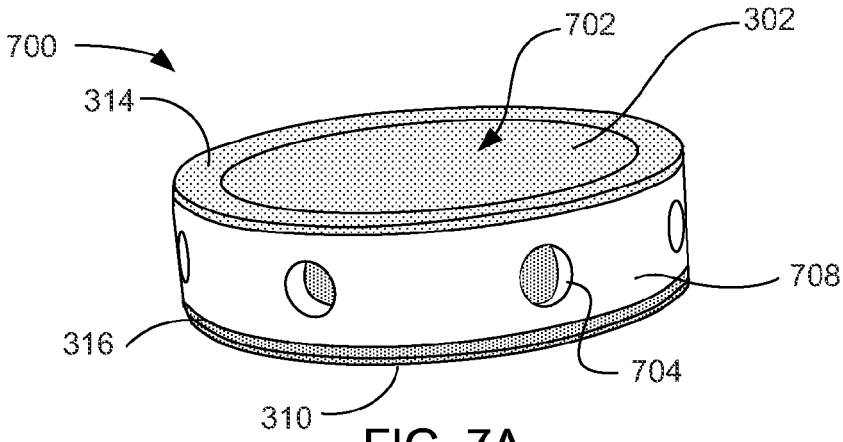
FIG. 7 is a side perspective view illustrating an exemplary a combination of an exemplary flanged resilient ring and perforated metal ring, according to the preferred embodiment of FIG. 1.

FIG. 7A is a side-top perspective view illustrating a second exemplary combination 700 of an exemplary resilient ring 302 and perforated metal ring 708, according to a preferred embodiment. Perforated metal ring 708 has six perforations 704 (one of four labeled), unevenly spaced apart. Opening 702 through resilient ring 302 allows for the passage of water out of the water jet, as it becomes part of the water jet exit channel 108.

Figure 7B:
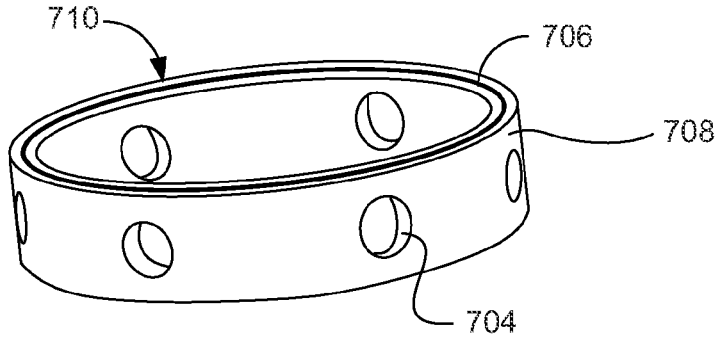

FIG. 7B is a side-top perspective view illustrating an exemplary perforated metal ring 708, according to the preferred embodiment of FIG. 7. The thickness of the perforated metal ring 708 is substantially equal to the extent of the bottom radially outward flange 316 and the top radially outward flange 314 and the top surface 710 includes an annular groove 706 for receiving integral top ring seal 304. In an alternate embodiment, more than one annular groove 706 and more than one integral top ring seal 304 may be provided.

Figure 8:
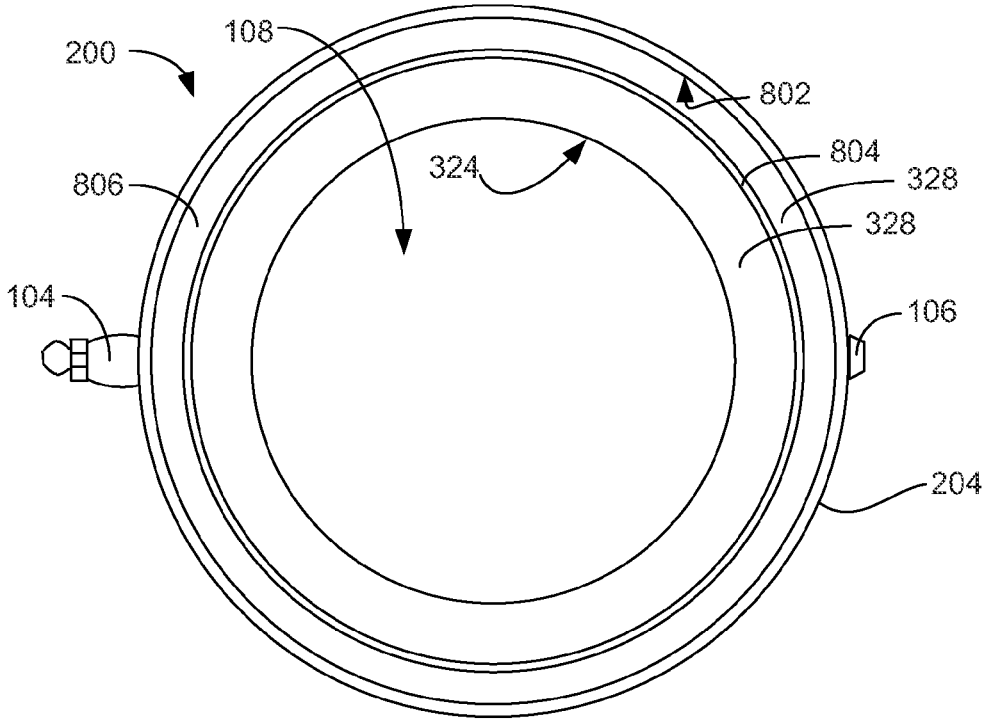
FIG. 8 is a top plan view illustrating an exemplary perforated metal ring, according to the preferred embodiment of FIG.

FIG. 8 is a top plan view illustrating an exemplary canister 204 of an exemplary nozzle insert 200 of the exemplary improved variable-dimension water jet nozzle 100, according to the preferred embodiment of FIG. 1. Canister 204 has annular floor 328 surrounding opening 108.

Annular floor 328 has groove 804 for receiving bottom integral ring seal 310. Interior surface 802 of canister 204 is a wall of expandable plenum 320 when the exemplary improved variable-dimension water jet nozzle 100 is fully assembled in an alternate embodiment, more than one groove 804 and more than one integral bottom ring seal 310 may be provided.

Figure 9:
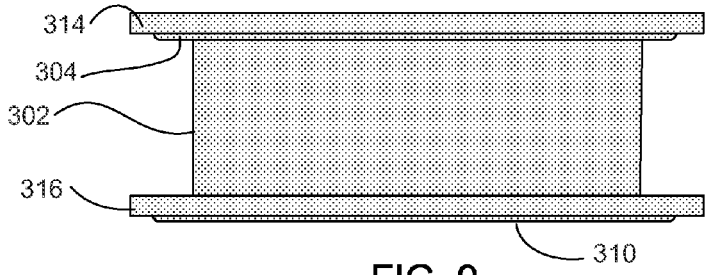
FIG. 9 is a side elevation view illustrating an exemplary flanged resilient ring, according to the preferred embodiment of the present invention.

FIG. 9 is a side elevation view illustrating an exemplary flanged resilient ring 302, according to the preferred embodiment of the present invention. The cylindrical resilient ring 302 has top radially outward flange 314 and bottom radially outward flange 316. The top radially outward flange 314 has an integral top ring seal 304 on its lower surface, sometimes called an O-ring seal (but here, only a portion of an O-ring seal), that seats in annular groove 706. The bottom radially outward flange 316 has an integral bottom ring seal 310 on its lower surface, that seats in annular groove 804. Flanged resilient ring 302 is preferably molded of a single piece of flexible resilient material.

Figure 10:
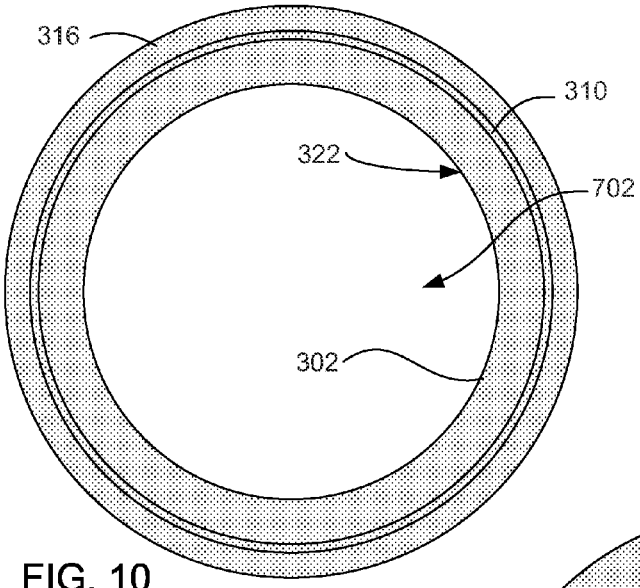
FIG. 10 is a bottom plan view illustrating the flanged resilient ring of FIG. 9, according to the preferred embodiment of FIG. 1.

FIG. 10 is a bottom plan view illustrating the flanged resilient ring 302 of FIG. 9, according to the preferred embodiment of FIG. 1. Opening 702 through resilient ring 302 is a resilient portion of the water jet exit channel 108 that allows for the passage of water out of the water jet. In various alternate embodiments, shapes other than annular may be used for the resilient ring 302, perforated metal ring 708, canister 204, and sleeve 202. For example, a cross-sectional shape that is oval, elliptical, or polygonal with rounded corners may be used.

Figure 11:
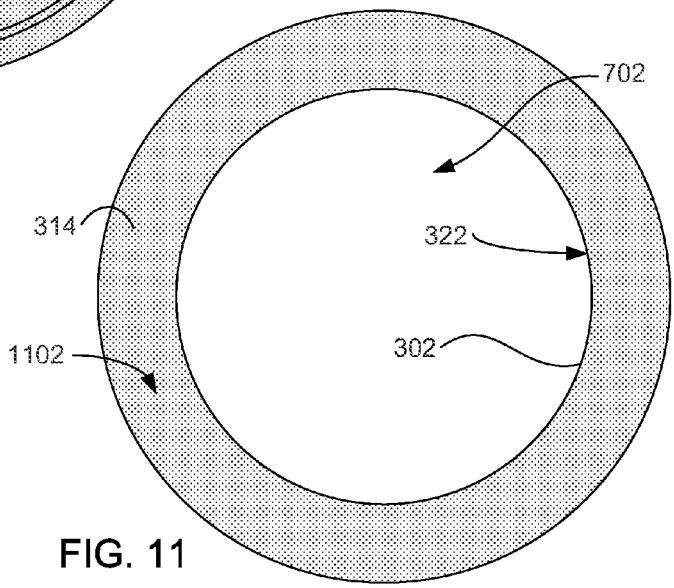
FIG. 11 is a top plan view illustrating the flanged resilient ring of FIG. 9, according to a preferred embodiment of FIG. 1.

FIG. 11 is a top plan view illustrating the flanged resilient ring 302 of FIG. 9, according to a preferred embodiment of FIG. 1. In various alternate embodiments, the top surface 1102 of top radially outward flange 314 may be equipped with one or more integral ring seals, like ring seal 310.

Figure 12:
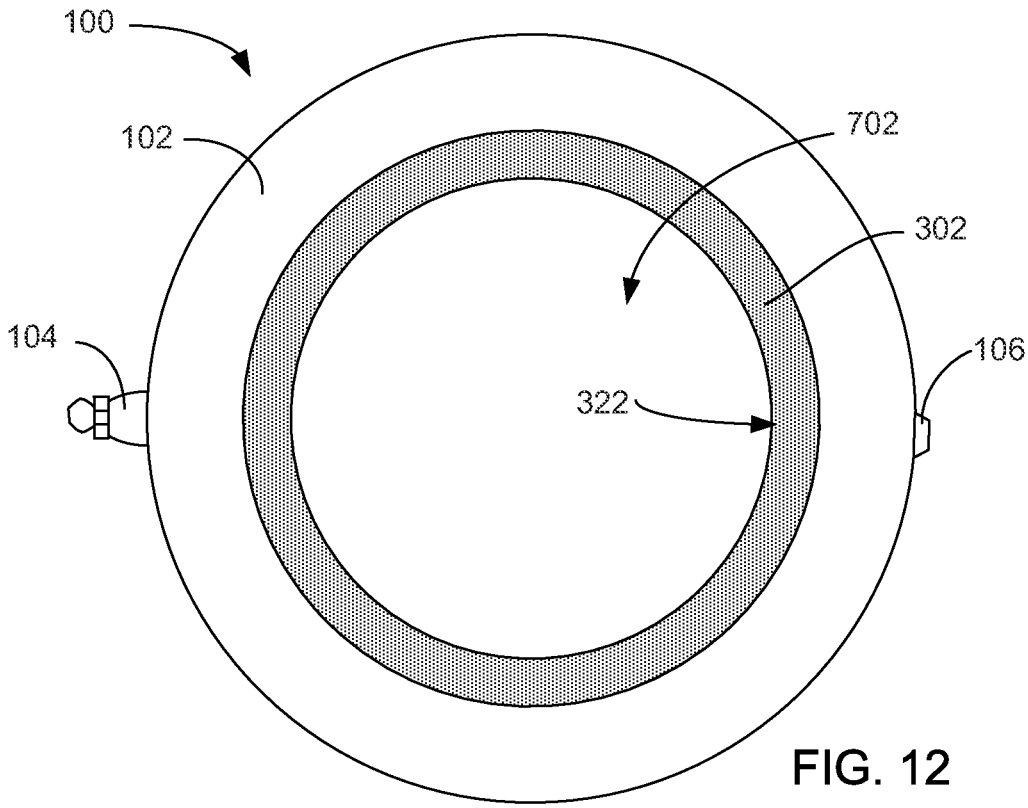
FIG. 12 is a top plan view illustrating the exemplary improved variable-dimension water jet nozzle with the flexible flanged ring partially inflated, according to the preferred embodiment of FIG. 1.

FIG. 12 is a top plan view illustrating the exemplary improved variable-dimension water jet nozzle 100 with the flanged resilient ring 302 partially inflated, according to the preferred embodiment of FIG. 1. Pressurized hydraulic oil is introduced through hydraulic fitting 104 to distend the exit channel surface 322 of resilient ring 302 to reduce the effective diameter of the opening 702 of the improved variable-dimension water jet nozzle 100, causing the water to leave the nozzle 100 at higher velocity but lower power.

Figure 13:
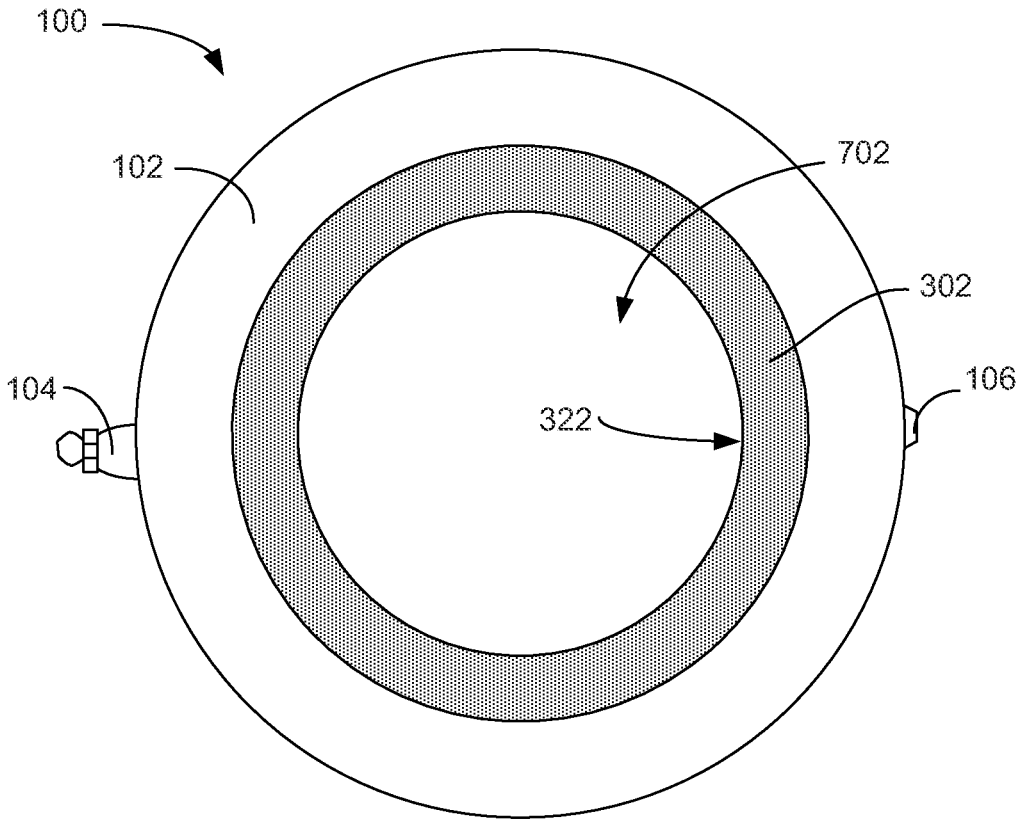
FIG. 13 is a top plan view illustrating the exemplary improved variable-dimension water jet nozzle with the flexible flanged ring fully inflated, according to the preferred embodiment of FIG. 1.

FIG. 13 is a top plan view illustrating the exemplary improved variable-dimension water jet nozzle 100 with the flanged resilient ring 302 fully inflated, according to the preferred embodiment of FIG. 1. In various alternate embodiments, more or less reduction of the effective nozzle diameter may be provided corresponding to greater or lesser maximum inflation extents for the resilient ring 302. In a particular embodiment, the extent of distension may be controlled to provide initial backpressure to avoid cavitations of the when starting the watercraft 1700 from a standing start. Avoiding impeller 1710 (See FIG. 17) cavitations allows the watercraft 1700 to transfer more power to the water jet stream than a cavitating impeller 1710 can transfer, enabling more rapid standing starts than fixed-nozzle systems can provide.

Figure 14:
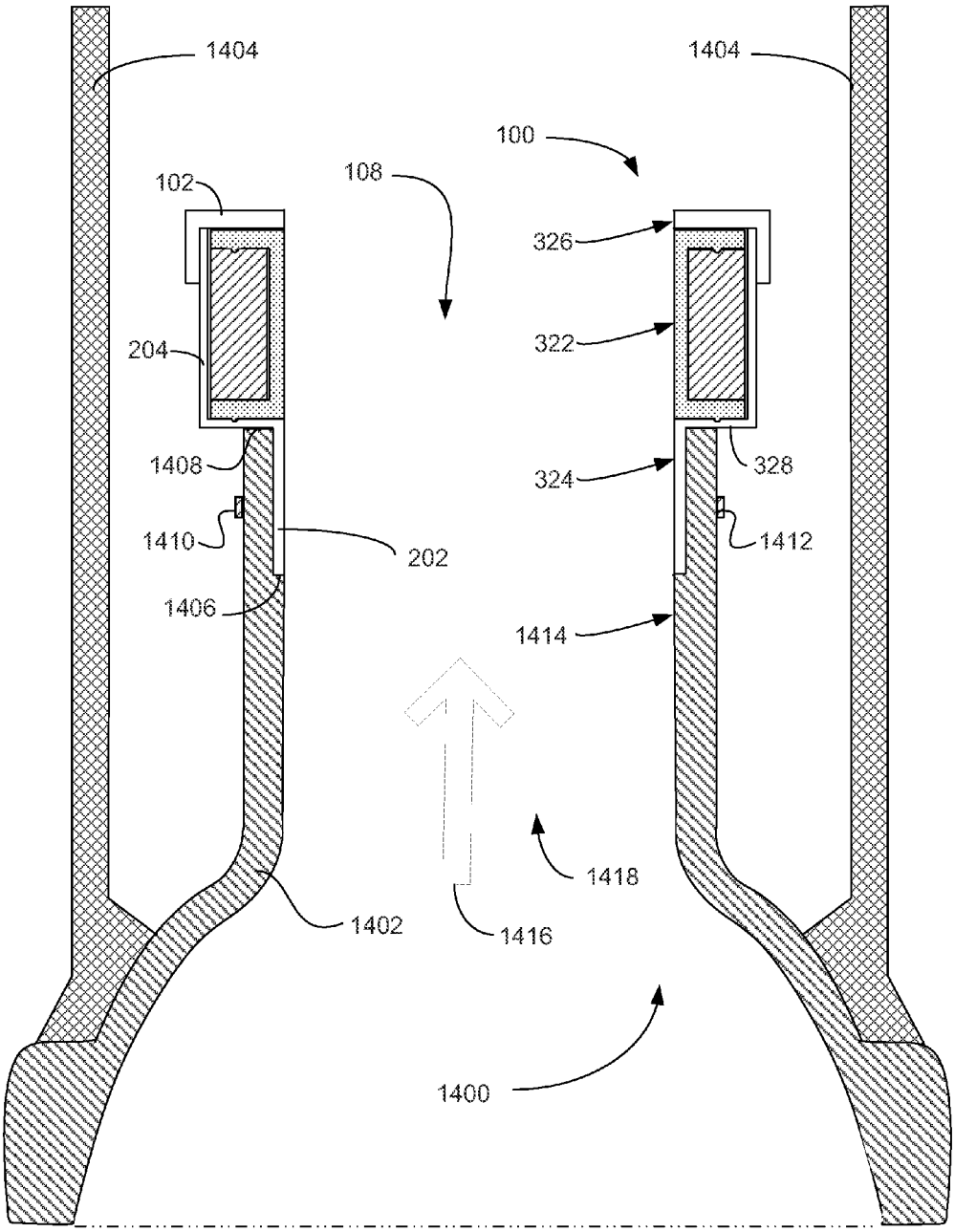
FIG. 14 is a side cross-sectional view illustrating the exemplary improved variable-dimension water jet nozzle attached to a water jet exit nozzle, according to the preferred embodiment of FIG. 1.

FIG. 14 is a side cross-sectional view illustrating the exemplary improved variable-dimension water jet nozzle 100 attached to a water jet exit structure 1400, according to the preferred embodiment of FIG. 1. Convergent structure 1402 has radial symmetry and conducts water up 1416 and through a cylindrical portion 1418 and through improved variable-dimension water jet nozzle 100, shown minimally inflated.

Sleeve 202 slides into annular notch 14106 to make sleeve interior surface 324 flush with exit structure interior surface 1414. In the minimally inflated state, as shown, surfaces 1414, 324, 322, and 326 are flush, and provide an exit channel 108 equal in diameter to the cylindrical portion 1418 of exit structure 1400 without the notch 1406. Accordingly, thrust is not significantly degraded by the addition of the improved variable-dimension water jet nozzle 100. Improved variable-dimension water jet nozzle 100 is secured to exit structure 1400 using set screws 1410 and 1412 or the like. The bottom 328 of canister 204 rests on the top surface 1408 of the exit structure 1400. In an alternate embodiment, canister 204 may be manufactured as integral to exit structure 14100.

Struts 1404 are sized to support directional deflectors that deflect the exit stream of water to assist with steering the watercraft 1700. Extensions to struts 1404 may be required to achieve extension beyond improved variable-dimension water jet nozzle 100 for aftermarket applications.

Figure 15:
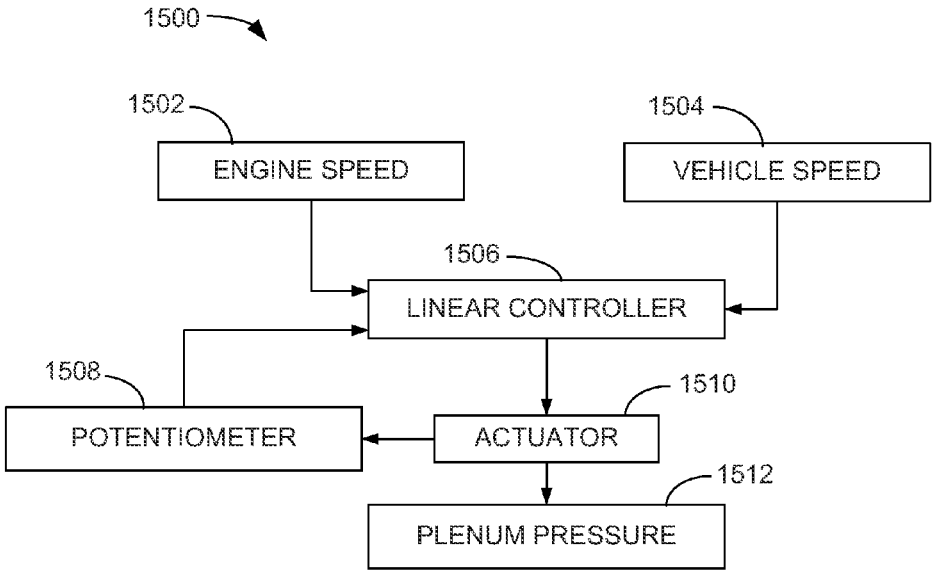
FIG. 15 is a diagrammatic view illustrating an exemplary control strategy for the improved variable-dimension water jet nozzle, according to the preferred embodiment of FIG. 1.

FIG. 15 is a diagrammatic view illustrating an exemplary control strategy 1500 for the improved variable-dimension water jet nozzle 100, according to the preferred embodiment of FIG. 1. Engine speed 1502 and vehicle speed 1504 are led into linear controller 1506 to produce an actuator 1510 command 1612 to change plenum pressure 1512 as appropriate for the inputs. The actuator 1511) also moves a potentiometer 1508 to provide linear feedback to linear controller 1506. For example, a high engine speed 1502 and a tow vehicle speed 1504 indicate a need for acceleration and, therefore, power. Accordingly, a low plenum pressure 1512 is produced according to the control strategy 1500. For another example, a high engine speed 1502 and a high vehicle speed 1504 indicate a need for speed, and therefore, high exit stream velocity. Accordingly, a high plenum pressure 1508 is produced according to the control strategy 1500.

Figure 16:
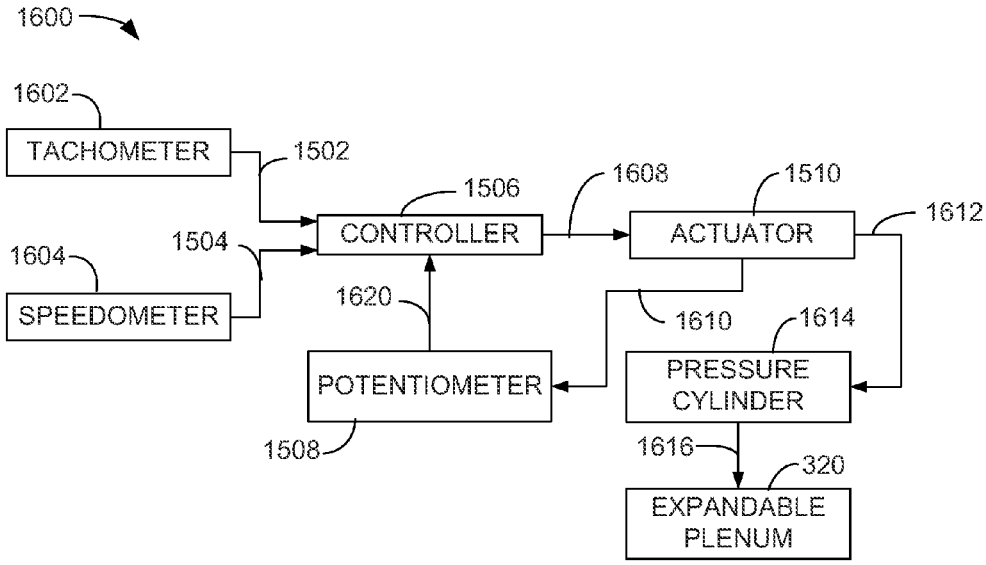
FIG. 16 is a diagrammatic view of the elements of an exemplary control system for implementing the control strategy of FIG. 15, according to the preferred embodiment of FIG. 1.

FIG. 16 is a diagrammatic view of the elements of an exemplary control system 1600 for implementing the control strategy 1500 of FIG. 15, according to the preferred embodiment of FIG. 1. Tachometer 1602 provides engine speed 1502 to controller 1506. A speedometer 1604 provides vehicle speed 1504 to controller 1506. Controller 1506 provides an actuator control signal 1608 to actuator 1510, such as a shaft drive, which moves a piston 1612 in pressure cylinder 1614 to compress or decompress hydraulic oil in the pressure cylinder 1614. The pressure cylinder 1614 provides pressurized hydraulic oil over a hydraulic conduit 1616 to the expandable plenum 320 to expand or contract resilient ring 302. Actuator 1510 position 1610 is sensed by potentiometer 1508 which provides feedback 1620 to the controller 1506. The 1604 may be, for example, a GPS receiver, an inertial guidance unit, a paddlewheel speedometer, or a conventional speedometer. The actuator 1510 and potentiometer 1508 may be commercially obtained as a single unit, such as those sold by Firgelli Automations of Ferndale, Wash. The control strategy 1500 and control system 1600 are preferred but exemplary. Other control strategies and control systems, based on engine speed and vehicle speed and optionally additional data, are within the scope of the invention.

In a particular embodiment, the extent of distension may be controlled to provide initial backpressure to avoid cavitations of the impeller when starting the watercraft 1700 from a standing start. Avoiding impeller 1710 (See FIG. 17) cavitations allows the watercraft 1700 to transfer more power to the water jet stream than a cavitating impeller 1710 can transfer enabling more rapid standing starts than fixed-nozzle systems can provide.

Figure 17:
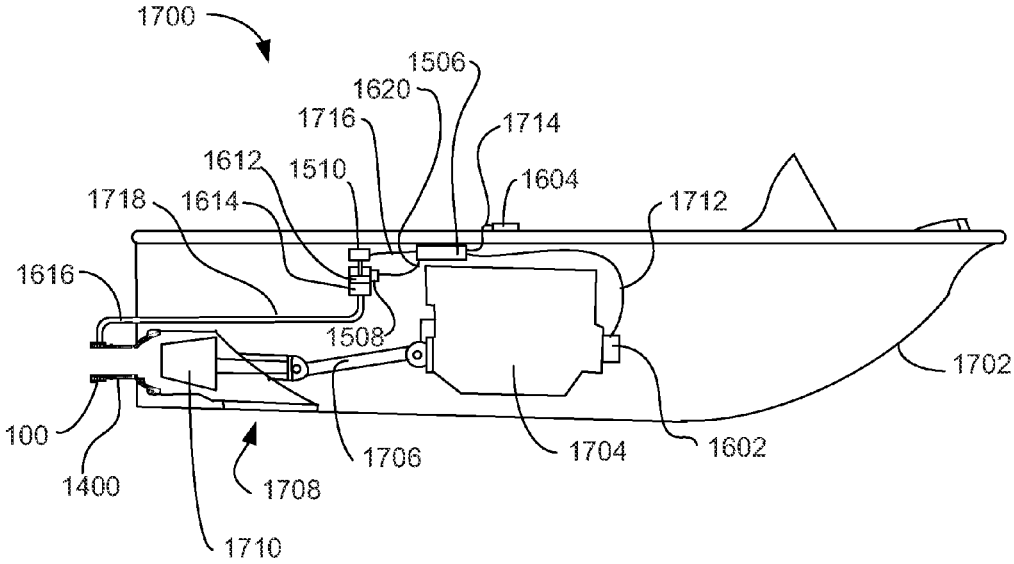
FIG. 17 is a diagrammatic side x-ray view illustrating the exemplary improved variable-dimension water jet nozzle and its exemplary control system integrated into an exemplary watercraft, according to the preferred embodiment of FIG. 1.

FIG. 17 is a diagrammatic side x-ray view illustrating the exemplary improved variable-dimension water jet nozzle 100 and its exemplary control system 1600 integrated into an exemplary watercraft 1700, according to the preferred embodiment of FIG. 1. Exemplary watercraft 1700 may be any type of water-jet-propelled watercraft, including personal watercraft, boats, ships, amphibious vehicles, torpedoes, or submarines. Engine 1704 is housed in a hydrodynamic structure (for example, a hull) 1702. Drive train 1706 couples engine 1704 output power to impeller 1710 which draws water from inlet 1708 and forces the water out through exit structure 1400 and through improved variable-dimension water jet nozzle 100. Controller 1506 receives vehicle speed 1504 input from speedometer 1604 over signal conduit 1714. Signal conduits, such as signal conduits 1714, may be wire, fiber optic, wireless transmission, or fluidic conduit. Tachometer 1602 measures the engine speed 1502 and provides the result to controller 1506 via signal conduit 1712. Controller 1506 calculates an actuator control signal 1608 and provides it to actuator 1510. Actuator 1510 moves piston 1612 to change the pressure in the pressure cylinder 1614. Hydraulic pressure in hydraulic cylinder 1616 is communicated over hydraulic conduit 1616 and changes the pressure in the expandable plenum 320 in improved variable-dimension water jet nozzle 100. The position of actuator 1510 is sensed by potentiometer 1508 which provides feedback 1620 to controller 1506.

The coupling of the variable-dimension water jet nozzle 100 to a water jet exit structure 1400 is an embodiment of the present invention. The coupling to a watercraft 1700 of the water jet exit structure 1400 coupled to the variable-dimension water jet nozzle 100 is an embodiment of the present invention. The coupling to a watercraft 1700 of a control system 1600 for control of a variable-dimension water jet nozzle 100 is an embodiment of the present invention. The coupling of a control system 1600 for control of a variable-dimension water jet nozzle 100 to a variable-dimension water jet nozzle 100 is an embodiment of the present invention.

Figure 18:
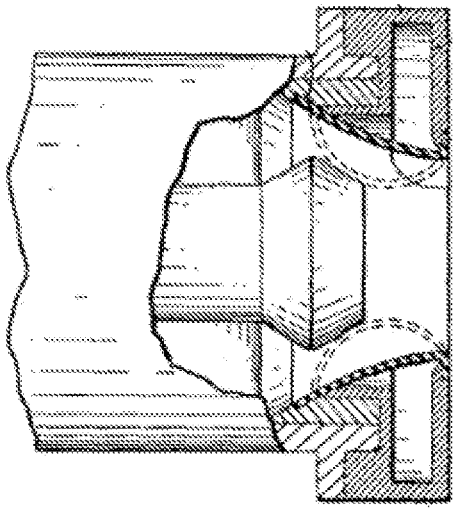
PRIOR ART FIG. 18
FIG. 18 is an illustration of the prior art of Englehart, et al.

FIG. 18 is a side cutaway view of a prior art water jet nozzle according to U.S. Pat. No. 3,279,704 to Englehart, et al., as discussed above.

Figure 19:
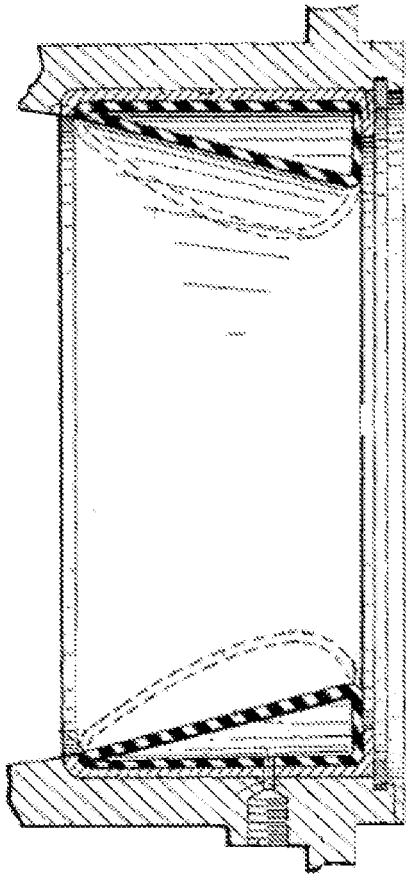
PRIOR ART FIG. 19
FIG. 19 is an illustration of the prior art of Cochran.

FIG. 19 is a cross-sectional view of a prior art water jet nozzle according to U.S. Pat. No. 3,214,903 to Cochran, as discussed above.

Figure 20:
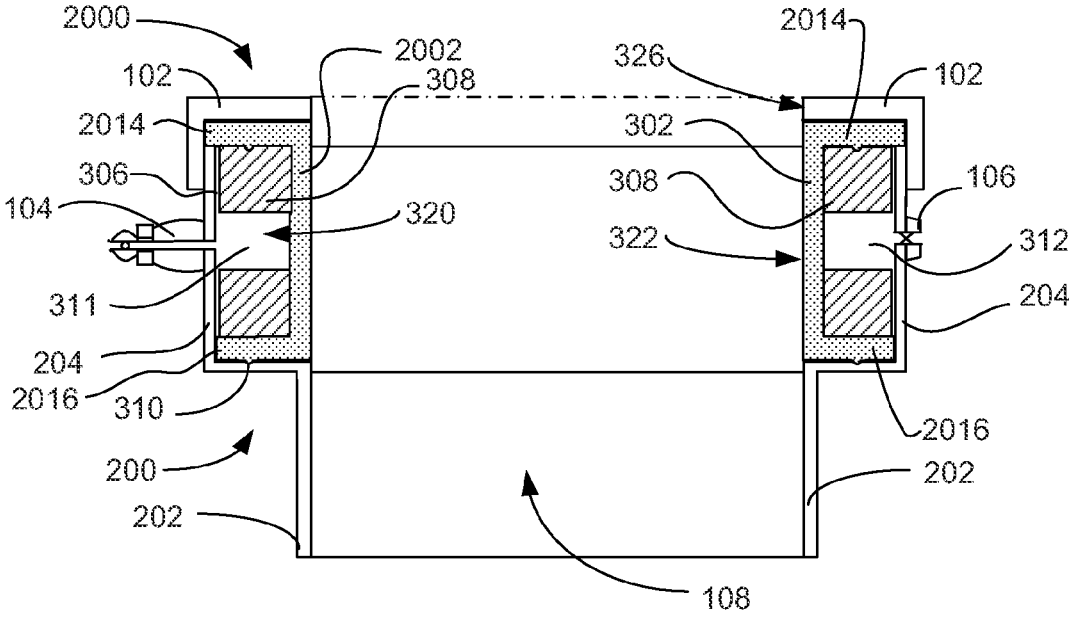
FIG. 20 is a side cross-sectional view illustrating an exemplary alternate embodiment of improved variable-dimension water jet nozzle, showing the resilient ring minimally inflated and flush with the inner surface of the cylindrical nozzle insert, according to a preferred embodiment of the present invention.

FIG. 20 is a side cross-sectional view illustrating an exemplary alternate embodiment of improved variable-dimension water jet nozzle 2000, showing the resilient ring 2002 with an extended top radially outward flange 2014 and minimally inflated and flush with the inner surface 324 of the cylindrical nozzle insert 200, according to a preferred embodiment of the present invention. Top radially outward flange 2014 extends beyond the edge of perforated metal ring 308 and over the top edge of canister 204 and is clamped to the top edge of canister 204 by compressive cap 102. Bottom radially outward flange 2016 is the same as bottom radially outward flange 316.

Figure 21:
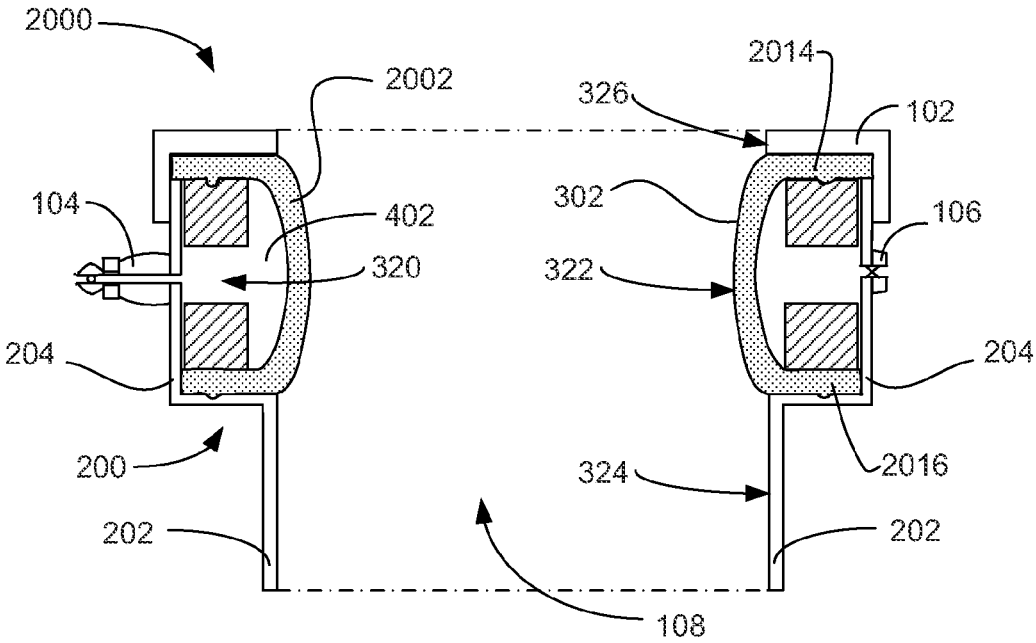
FIG. 21 is a side cross-sectional view through section A-A' illustrating an exemplary improved variable-dimension water jet nozzle, showing the resilient inflated and extending interior to the inner surface of the cylindrical nozzle insert, according to the preferred embodiment of FIG. 20.

FIG. 21 is a side cross-sectional view illustrating an exemplary alternate improved variable-dimension water jet nozzle 2000, showing the resilient ring 2002 inflated and extending interior to the inner surface 324 of the cylindrical nozzle insert 200, according to the preferred embodiment of FIG. 20. Top radially outward flange 2014 extends beyond the edge of perforated metal ring 308 and over the top edge of canister 204 and is clamped to the top edge of canister 204 by compressive cap 102. Bottom radially outward flange 2016 is the same as bottom radially outward flange 316.

Figure 22:
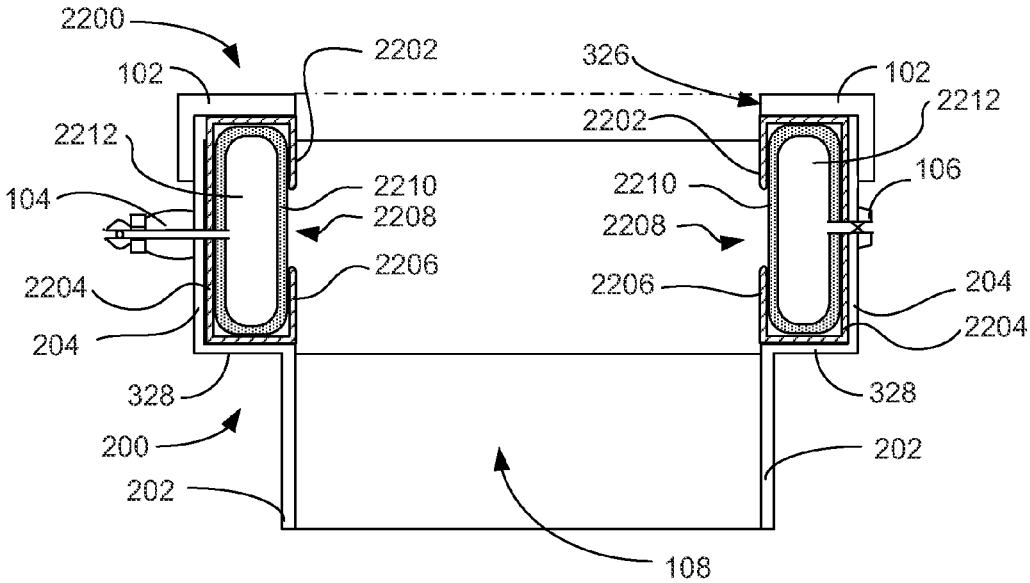
FIG. 22 is a side cross-sectional view illustrating another exemplary alternate embodiment of improved variable-dimension water jet nozzle, showing a flexible tube ring minimally inflated and within the inner surface of the cylindrical nozzle insert, according to a preferred embodiment of the present invention.

FIG. 22 is a side cross-sectional view illustrating another exemplary alternate embodiment of improved variable-dimension water jet nozzle 2200, showing a flexible tube ring 2210 minimally inflated and within the inner surface of the cylindrical nozzle insert 200, according to a preferred embodiment of the present invention. Flexible tube ring 2210 is similar to an inner tube used for automotive tires, but is smaller, uses hydraulic fluid 2212 pressure, has the hydraulic fitting 104 on the outside, and has a bleed valve 106. Flexible tube ring 2210 is partially enclosed in an annular container 2204 of generally rectangular cross-section that has an opening 2208 for allowing the flexible tube ring 2210 to expand into the flow channel when under pressure. Annular container 2204 is clamped between the compressive cap 102 and the floor 328 of canister 204. The inner wall of annular container 2204 has an upper portion 2202 and a lower portion 2206, with opening 2208 between them. Inner edges of upper and lower wall portions 2202 and 2206 are preferably smooth and rounded to reduce wear on the flexible tube ring 2210. In an alternate embodiment, upper portion 2202 may be of one piece with the compressive cap 102, lower portion 2206 may be of one piece with canister floor 328, and annular container 2204 is omitted, with the compressive cap 102 and canister 204 substituting for the annular container 2204.

Figure 23:
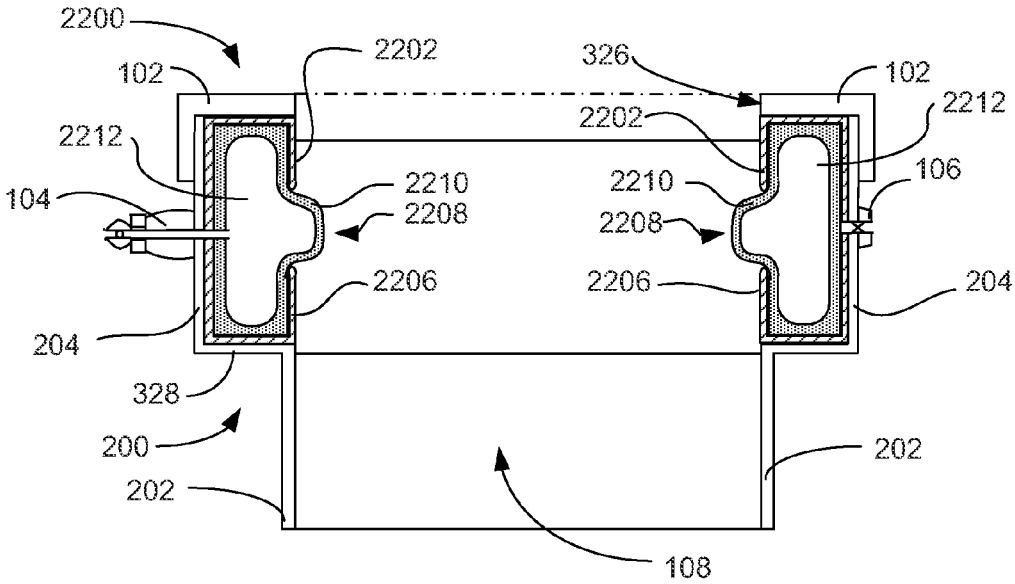
FIG. 23 is a side cross-sectional view through section A-A' illustrating an exemplary improved variable-dimension water jet nozzle, showing the flexible tube ring inflated and extending interior to the inner surface of the cylindrical nozzle insert, according to the preferred embodiment of FIG. 22.

FIG. 23 is a side cross-sectional view through section A-A' illustrating an exemplary improved variable-dimension water jet nozzle 2200, showing the flexible tube ring 2210 inflated and extending interior to the inner surface of the cylindrical nozzle insert 200, according to the preferred embodiment of FIG. 22. The extent of the intrusion into the flow channel 108 is dependent on the pressure of the hydraulic fluid 2212. In a particular embodiment, the quiescent pressure state may be sufficient to maintain the flexible tube ring 2210 extended into opening 2208 just enough to make the exposed surface of the flexible tube ring 2210 flush with the outer surfaces of upper and lower wall portions 2202 and 2206.

All the embodiments herein are merely exemplary. Those of skill in the art, enlightened by this disclosure, will appreciate the variations that may be achieved. For example, the resilient ring 302 may be segmented circumferentially with coordinated controls to differentially inflate each segment, to assist in thrust vectoring.

While several exemplary embodiments have been presented in the foregoing detailed description, it should be appreciated that a vast number of variations exist. It should also be appreciated that the exemplary embodiments are only examples, and are not intended to limit the scope, applicability, or configuration of the invention in any way. Rather, the foregoing detailed description will provide those skilled in the art with a convenient road map for implementing the exemplary embodiments. It should be understood that various changes can be made in the function and arrangement of elements without departing from the scope of the invention as set forth in the appended claims and the legal equivalents thereof.

I claim:

1. A variable-dimension water jet comprising:

a. a water jet exit channel comprising:

i. at least one rigid cylindrical portion comprising:

1. an exit channel dimension;
2. an exit channel length; and
3. at least one inner cylindrical surface having said exit channel dimension for at least a portion of said exit channel length;

ii. at least one resilient exit channel wall portion comprising at least one exit channel surface, wherein said at least one exit channel surface is flush to said at least one inner cylindrical surface in a first state, and wherein said at least one resilient exit channel wall portion further comprises a canister, a rigid ring with a plurality of radial perforations, a resilient ring mounted on said rigid ring, and an annular cap operable to compress said resilient ring;

b. at least one plenum adjacent said resilient exit channel wall portion; and c. at least one pressure inlet into said plenum, operable to conduct pressurized fluid into said at least one plenum to distend said resilient exit channel wall portion into said water jet exit channel.

2. The variable-dimension water jet of claim 1, wherein:

a. said canister comprises:

i. a cylindrical canister wall;

ii. an annular canister floor; and iii. a receiver for receiving said compressive annular cap operable to be releasably compressively attached to said canister;

b. said rigid ring comprises inner, outer, top, and bottom ring surfaces and a plurality of radial perforations;

c. said resilient ring, comprises:

i. a particular exit channel surface of said at least one exit channel surface comprising an inner surface of said resilient ring;

ii. an outer surface opposed to said particular exit channel surface; and iii. top and bottom flanges extending radially outward;

iv. wherein said resilient ring is mountable on said perforated rigid ring with:

1. said top and bottom outwardly extending flanges engaging at least a portion of said top and bottom ring surfaces; and
2. said outer resilient ring surface abutting said inner rigid ring surface; and d. said compressive annular cap is operable to compress said resilient ring mounted on said rigid ring between said annular canister floor and said compressive annular cap.

3. The variable-dimension water jet of claim 2, further comprising a cylindrical sleeve with an inner dimension equal to said exit channel dimension and extending axially from an inner edge of said annular canister floor.

4. The variable-dimension water jet of claim 2, comprising at least one bleed valve through said cylindrical canister wall and into said at least one plenum.

5. The variable-dimension water jet of claim 2, wherein a particular plenum of said at least one plenum comprises a combination of:

a. at least one space between an interior surface of said cylindrical canister wall and said outer surface of said resilient ring mounted on said rigid ring; and b. spaces within said radial perforations in said rigid ring.

6. The variable-dimension water jet of claim 2, wherein said upper flange of said resilient ring extends sufficiently to cover a top surface of said cylindrical canister wall, when assembled.

7. The variable-dimension water jet of claim 2, comprising:

a. a first annular groove in said top surface of said rigid ring; and b. an integral portion of an O-ring extending from a bottom surface of said top flange of said resilient ring that is sized and shaped to be received in said first annular groove.

8. The variable-dimension water jet of claim 2, comprising:

a. a second annular groove in a top surface of said annular canister floor; and b. an integral portion of an O-ring extending from a bottom surface of said bottom flange of said resilient ring that is sized and shaped to be received in said second annular groove.

9. The variable-dimension water jet of claim 2, wherein, when assembled, said at least one pressure inlet is aligned to at least one perforation of said radial perforations.

10. The variable-dimension water jet of claim 2, comprising a water jet exit structure coupled to said water jet nozzle.

11. The variable-dimension water jet of claim 10, comprising a watercraft coupled to said water jet exit structure coupled to said water jet nozzle.

12. The variable-dimension water jet of claim 1, wherein said at least one plenum comprises a space between an inner surface of a cylindrical wall of said canister and an outer surface of said radially perforated rigid ring within said cylindrical wall together with spaces within said perforations.

13. The variable-dimension water jet of claim 1, wherein the pressure of said pressurized fluid at said pressure inlet is controlled by a controller to trade off power and speed.

14. The variable-dimension water jet of claim 13, wherein said controller is an electronic linear controller comprising:

a. input connectivity for signals indicating engine speed and vehicle speed;
b. output connectivity for a signal actuating pressure in said plenum; and
c. feedback connectivity for a signal indicating an actuator state.

15. The variable-dimension water jet of claim 14, further comprising a watercraft, wherein said electronic linear controller is coupled to said watercraft.

16. The variable-dimension water jet of claim 1, wherein the pressure of said pressurized fluid at said at least one pressure inlet is controlled to reduce impeller cavitations during standing starts of a watercraft.

17. The variable-dimension water jet of claim 1, further comprising a watercraft coupled to said variable-dimension water jet.

18. A variable-dimension water jet comprising:

a. a water jet exit channel comprising:
  i. at least one rigid cylindrical portion comprising:
    1. an exit channel dimension;
    2. an exit channel length; and
    3. at least one inner cylindrical surface having said exit channel dimension for at least a portion of said exit channel length;
  ii. at least one resilient exit channel wall portion comprising at least one exit channel surface, wherein said at least one exit channel surface is flush to said at least one inner cylindrical surface in a first state;
b. at least one plenum behind said resilient exit channel wall portion wherein said at least one plenum comprises one of
  i. a tube ring; and
  ii. a space between an inner surface of a cylindrical wall and an outer surface of a radially perforated rigid ring mounted within said cylindrical wall together with spaces within said perforations;
c. at least one pressure inlet into said plenum, operable to conduct pressurized fluid into said at least one plenum to distend said resilient exit channel wall portion into said water jet exit channel;
  i. wherein the pressure of said pressurized fluid at said pressure inlet is controlled by a controller to at least one of:
    1. trade off power and speed; and
    2. reduce impeller cavitations during standing starts of a watercraft;
  ii. wherein said controller is an electronic linear controller comprising:
    1. input connectivity for signals indicating engine speed and vehicle speed;
    2. output connectivity for a signal actuating pressure in said plenum; and
    3. feedback connectivity for a signal indicating an actuator state.

19. The variable-dimension water jet of claim 18, wherein said at least one resilient exit channel wall portion comprises a portion of a water jet nozzle, said water jet nozzle comprising:

a. a canister comprising:
  i. said cylindrical wall;
  ii. an annular canister floor; and
  iii. a receiver for receiving an annular compressive cap operable to be releasably compressively attached to said canister;
b. said rigid ring further comprising inner, top, and bottom ring surfaces;
c. a resilient ring, comprising:
  i. a particular exit channel surface of said at least one exit channel surface comprising an inner surface of said resilient ring;
  ii. an outer surface opposed to said particular exit channel surface; and
  iii. top and bottom flanges extending radially outward;
  iv. wherein said resilient ring is mountable on said perforated rigid ring with:
    1. said top and bottom outwardly extending flanges engaging at least a portion of said top and bottom ring surfaces; and
    2. said outer resilient ring surface abutting said inner rigid ring surface; and
d. said compressive annular cap operable to compress said resilient ring mounted on said rigid ring between said annular canister floor and said compressive annular cap;
e. a cylindrical sleeve with an inner dimension equal to said exit channel dimension and extending axially from an inner edge of said annular canister floor;
f. at least one bleed valve through said cylindrical canister wall and into said at least one plenum;
g. a first annular groove in said top surface of said rigid ring;
h. an integral portion of an O-ring extending from a bottom surface of said top flange of said resilient ring that is sized and shaped to be received in said first annular groove;
i. a second annular groove in a top surface of said annular canister floor; and
j. an integral portion of an O-ring extending from a bottom surface of said bottom flange of said resilient ring that is sized and shaped to be received in said second annular groove.

20. A variable-dimension water jet comprising:

a. a water jet exit channel comprising:
  i. at least one rigid cylindrical portion comprising:
    1. an exit channel dimension;
    2. an exit channel length;
    3. at least one inner cylindrical surface having said exit channel dimension for at least a portion of said exit channel length;
  ii. at least one resilient exit channel wall portion comprising at least one exit channel surface, wherein said at least one exit channel surface is flush to said at least one inner cylindrical surface in a first state;

b. at least one plenum behind said resilient exit channel wall portion wherein said at least one plenum comprises one of:
   i. a tube ring; and
   ii. a space between an inner surface of a cylindrical wall and an outer surface of a radially perforated rigid ring mounted within said cylindrical wall together with spaces within said perforations;
c. at least one pressure inlet into said plenum, operable to conduct pressurized fluid into said at least one plenum to distend said resilient exit channel wall portion into said water jet exit channel;
   i. wherein the pressure of said pressurized fluid at said pressure inlet is by a controller to at least one of:
      1. trade off power and speed; and
      2. reduce impeller cavitations during standing starts of a watercraft;
   ii. wherein said controller is an electronic linear controller comprising:
      1. input connectivity for signals indicating engine speed and vehicle speed;
      2. output connectivity for a signal actuating pressure in said plenum; and
      3. feedback connectivity for a signal indicating an actuator state;
d. wherein said at least one resilient exit channel wall portion comprises one of:
   i. a built in feature of said water jet exit structure; and
   ii. a portion of a water jet nozzle attachable to said water jet exit structure, said water jet nozzle comprising:
      1. a canister comprising:
         a. said cylindrical wall;
         b. an annular canister floor; and
         c. a receiver for receiving an compressive annular cap operable to be releasably compressively attached to said canister;
      2. said rigid ring further comprising inner, top, and bottom ring surfaces;
      3. a resilient ring, comprising:
         a. a particular exit channel surface of said at least one exit channel surface comprising an inner surface of said resilient ring;
         b. an outer surface opposed to said particular exit channel surface; and
         c. top and bottom flanges extending radially outward;
         d. wherein said resilient ring is mountable on said perforated rigid ring with:
            i. said top and bottom outwardly extending flanges engaging at least a portion of said top and bottom ring surfaces; and
            ii. said outer resilient ring surface abutting said inner rigid ring surface;
      4. said compressive annular cap operable to compress said resilient ring mounted on said rigid ring between said annular canister floor and said compressive annular cap;
      5. a cylindrical sleeve with an inner dimension equal to said exit channel dimension and extending axially from an inner edge of said annular canister floor;
      6. at least one bleed valve through said cylindrical canister wall and into said at least one plenum;
      7. a first annular groove in said top surface of said rigid ring;
      8. an integral portion of an O-ring extending from a bottom surface of said top flange of said resilient ring that is sized and shaped to be received in said first annular groove;
      9. a second annular groove in a top surface of said annular canister floor; and
      10. an integral portion of an O-ring extending from a bottom surface of said bottom flange of said resilient ring that is sized and shaped to be received in said second annular groove.

* * * * *